United States Patent [19]

Strom

[11] 4,378,131

[45] Mar. 29, 1983

[54] METHOD FOR RESTORING MOLYBDENUM TO BASE LINE LEVEL IN LEACHED FORMATION

[75] Inventor: E. Thomas Strom, Dallas, Tex.

[73] Assignee: Mobil Oil Corporation, New York, N.Y.

[21] Appl. No.: 221,727

[22] Filed: Dec. 31, 1980

[51] Int. Cl.[3] ..... E21B 43/28

[52] U.S. Cl. ..... 299/5; 299/4

[58] Field of Search ..... 166/275, 305.R; 299/4, 299/5; 423/15, 17, 20, 261

[56] References Cited

U.S. PATENT DOCUMENTS 4,079,783 3/1978 Snavely et al. ..... 299/4

4,114,693 9/1978 Foster et al. ..... 299/4 X 4,134,618 1/1979 Kossack ..... 299/5

4,155,982 5/1979 Hunkin ..... 299/4 X 4,234,231 11/1980 Yan ..... 299/5

*Primary Examiner*—Stephen J. Novosad

*Assistant Examiner*—George A. Suchfield

*Attorney, Agent, or Firm*—Charles A. Huggett; Michael G. Gilman; John K. Abokhair

[57] ABSTRACT

A method is disclosed for restoring to environmentally acceptable levels the soluble molybdenum values in a subterranean formation which has been subjected to in situ oxidative leaching by passing through the leached formation an aqueous restoration fluid containing ferrous ion.

4 Claims, No Drawings

METHOD FOR RESTORING MOLYBDENUM TO BASE LINE LEVEL IN LEACHED FORMATION

FIELD AND BACKGROUND OF THE INVENTION

This invention relates to techniques for restoring subterranean formations which have been subjected to oxidative in situ leaching of uranium values.

Recovery of uranium values from subterranean formations involves in the usual methods the oxidation of insoluble tetravalent uranium into soluble uranyl complexes that may be drawn from the formation by leaching. The overall reaction in oxidative in situ leaching may be described as follows:

$$UO_2(S)+[O]+3HCO_3^- \rightarrow UO_2(CO_3)_3^{-4}+H^++H_2O$$

The use of oxygen, however, also solubilizes insoluble molybdenite into the toxic soluble molybdate ion:

$$MoS_2+9[O]+3H_2O \rightarrow MoO_4^{=}+6H^++2SO_4^{=}$$

Current environmental regulations restrict the amount of molybdenum permissible in formations after leaching to less than one ppm in New Mexico, for example.

SUMMARY AND DETAILED DESCRIPTION OF THE INVENTION

This invention involves a method for restoring to environmentally acceptable levels the soluble molybdenum values in a subterranean formation subjected to in situ oxidative leaching. The process in its essentials comprises passing through said formation an aqueous restoration fluid that normally contains 25 to 400 mg per liter of ferrous ions ($Fe^{++}$). While in principle any aqueous ferrous ion source is suitable for carrying out this invention, the ferrous ion is ordinarily introduced into the groundwater system in a common soluble form such as $FeSO_4$ or $FeCl_2$. The restoration fluid prior to being passed through the formation is normally deoxygenated to a low level, i.e., to an oxygen concentration in the order of 1 ppm or less, by such well-recognized techniques as purging with argon. In the event that the formation thus restored contains excessive ferrous ion concentrations above environmental background levels, these levels may be lowered by passing formation water through the formation and diluting the ferrous ion content therein.

This invention is believed to derive its effectiveness from the reducing capabilities of the ferrous ion. Of course, this stated belief is not intended to be binding. The toxic $Mo^{+6}$ state may be reduced to the $Mo^{+4}$ state by the following general reaction:

$$2Fe^{++}+Mo^{+6} \rightarrow 2Fe^{+++}+Mo^{+4}.$$

The reaction in a formation treated in accordance with this invention would then follow the reaction:

$$2Fe^{++}+MoO_4^{=}+2H_2O \rightarrow 2Fe^{+++}+MoO_2\downarrow+4OH^-$$

Thus, the $Mo^{+4}$ would settle out as precipitate, along with some of the $Fe^{+++}$ as the hydroxide. It is believed that similar reaction schemes apply to other soluble, toxic molybdenum species, such as $Mo^{+5}$, and to acid conditions, for example.

In carrying out this invention, the array of injection and production wells already in place to carry out the oxidative leaching process may be used for the injection of the aqueous restoration solution into the formation. The ferrous compound may be dissolved in a surface facility containing formation water which has first been purged of oxygen in order to avoid the oxidation of ferrous ion to ferric ion before the restoration fluid is allowed to react with the formation. The solution is then injected into the formation through the existing system of injection wells and recovered after passage through the formation at the existing production wells. In this manner, molybdenum levels in the formation can be brought down to environmentally acceptable levels, to as low as 1 ppm or less, after one or more pore volumes of the ferrous ion-containing restoration fluid have been passed through the formation. Whether this acceptable molybdenum level has been attained can be readily determined by measuring the molybdenum in the formation water by any standard analytical procedure such as atomic absorption spectroscopy, emission spectroscopy or the like. The optimum ferrous ion concentration in the restoration fluid will vary, depending upon the molybdenum background levels in the groundwater produced after leaching and/or the molybdenum mineralogy present in the particular formation. Normally the ion concentration can be in the range of 25 to 400 mg. per liter. However, it is necessary to observe these ferrous ion concentration limits because too high a concentration of ferrous ion will result in a reaction with water, e.g. in the restoration fluid itself, to yield insoluble ferrous oxides and/or hydroxides. Of course, the use of insufficient levels of ferrous ion concentration will render the process ineffective.

The applicability of the present invention has been determined by pumping restoration fluid which has been deoxygenated with argon to a level of about 1 ppm oxygen through a core sample made up from several ore segments taken from the Crownpoint area of New Mexico. Prior to treatment with the restoration fluid, the core sample was leached with a sodium bicarbonate/oxygen leachate to recover most (65–75%) of the total uranium in place. The restoration fluid was Dallas tap water to which had been added 1.0 g/l of $FeSO_4.7H_2O$ (approx. 200 mg/l $Fe^{++}$). As shown in Table 1 below, this procedure reduced the molybdenum concentration from about 0.8–1 ppm to approximately 0.3 ppm or less.

TABLE I

EFFECT ON 1.0 g/l $FeSO_4.7H_2O$ ON MOLYBDENUM IN EFFLUENT FROM 9U-174 CORE

| Sample Number | Cumulative Pore Volume | Δ Pore Volumes | $U_3O_8$ Concentration (ppm) | Molybdenum[a] Concentration (ppm) |
|---|---|---|---|---|
| 172 | 114.69 | 1.21 | 2.48 | 1.03 |
| 173 | 116.30 | 1.60 | 2.83 | 1.02 |
| 174 | 117.50 | 1.20 | 1.89 | 0.98 |
| 175 | 119.11 | 1.61 | 2.00 | 0.95 |
| 176 | 120.31 | 1.20 | 1.89 | 0.94 |
| 177[b] | 120.82 | 0.51 | 0 | 0.815 |
| 178 | 121.92 | 1.10 | 0 | 0.731 |
| 179 | 123.12 | 1.20 | 7.31 | 0.546 |
| 180 | 124.72 | 1.60 | 8.49 | 0.561 |
| 181 | 125.92 | 1.20 | 6.96 | 0.469 |
| 182 | 127.51 | 1.59 | 4.72 | 0.495 |
| 183 | 128.69 | 1.18 | 3.54 | 0.453 |
| 184 | 130.25 | 1.56 | 3.66 | 0.444 |

TABLE I-continued

EFFECT ON 1.0 g/l $FeSO_4.7\ H_2O$ ON MOLYBDENUM IN EFFLUENT FROM 9U-174 CORE

| Sample Number | Cumulative Pore Volume | Δ Pore Volumes | $U_3O_8$ Concentration (ppm) | Molybdenum[a] Concentration (ppm) |
|---|---|---|---|---|
| 185 | 131.43 | 1.18 | 2.36 | 0.498 |
| 186 | 132.99 | 1.56 | 3.54 | 0.412 |
| 187 | 134.16 | 1.17 | 0.71 | 0.290 |

[a]Molybdenum measured by argon plasma.
[b]1.0 g/l $FeSO_4.7\ H_2O$ added to reservoir after Sample #177 was collected.

Table 2 below sets forth the results of additional experiments conducted subsequently and sequentially upon the Crownpoint core sample employed above, but using as the restoration fluid Dallas tap water to which had been added 2.0 g/l of $FeSO_4.7H_2O$ (approx. 400 mg/l $Fe^{++}$) and then using as the restoration fluid Dallas tap water to which has been added 1.5 g/l $FeSO_4.7H_2O$ (approx. 300 mg/l $Fe^{++}$). The molybdenum concentrations dropped from about 2.0 ppm to about 0.6 ppm after the passage of about 2.5 (168.6–166.1) pore volumes through the cores, and eventually dropped to zero after passage of about 9.4 (178.0–168.6) more pore volumes.

TABLE II

EFFECT OF 1.5 AND 2.0 gl/l $FeSO_4.7\ H_2O$ ON MOLYBDENUM IN EFFLUENT FROM 9U-174 CORE

| Sample Number | Cumulative Pore Volume | Δ Pore Volumes | $U_3O_8$ Concentration (ppm) | Molybdenum[a] Concentration (ppm) |
|---|---|---|---|---|
| 211 | 161.57 | 1.24 | 1.65 | 2.00 |
| 212 | 163.21 | 1.64 | 4.60 | 2.08 |
| 213 | 164.85 | 1.64 | 3.30 | 1.94 |
| 214[b] | 166.08 | 1.23 | 0.24 | 1.91 |
| 215 | 166.79 | 0.71 | 3.34 | 2.48 |
| 216 | 167.97 | 1.18 | 3.06 | 1.27 |
| 217[c] | 168.62 | 0.65 | 1.65 | 0.655 |
| 218 | 169.85 | 1.23 | 2.83 | 0.6[d] |
| 219 | 170.81 | 0.96 | 1.18 | 0.4 |
| 220 | 171.91 | 1.10 | 1.65 | 0.3 |
| 221 | 174.00 | 2.09 | 0 | 0.2 |
| 222 | 175.20 | 1.20 | 0.47 | 0.3 |
| 223 | 176.84 | 1.64 | 0 | 0.1 |
| 224 | 178.04 | 1.20 | 0 | 0 |
| 225 | 182.14 | 4.09 | 0 | 0 |
| 226 | 183.64 | 1.50 | 2.24 | 0 |

TABLE II-continued

EFFECT OF 1.5 AND 2.0 gl/l $FeSO_4.7\ H_2O$ ON MOLYBDENUM IN EFFLUENT FROM 9U-174 CORE

| Sample Number | Cumulative Pore Volume | Δ Pore Volumes | $U_3O_8$ Concentration (ppm) | Molybdenum[a] Concentration (ppm) |
|---|---|---|---|---|
| 227 | 184.91 | 1.27 | 2.48 | 0 |
| 228 | 186.60 | 1.69 | 0 | 0 |
| 229[e] | 187.87 | 1.27 | 0 | 0 |
| 230 | 190.65 | 2.78 | 0.47 | 0 |
| 231 | 193.24 | 2.59 | 0.59 | 0 |
| 232 | 194.52 | 1.28 | 0 | 0 |

[a]Molybdenum measured by argon plasma for Samples 211–217.
[b]2.0 g/1 $FeSO_4.7\ H_2O$ put in reservoir after collection of Sample 214.
[c]1.5 g/1 $FeSO_4.7\ H_2O$ put in reservoir after collection of Sample 217.
[d]Molybdenum measured by atomic absorption for Samples 218–232.
[e]Iron treatment stopped and deoxygenated water put in reservoir after collection of Sample 229.

The foregoing description of this invention has been directed to particular details in accordance with the requirements of the Patent Act and for purposes of explanation and illustration. It will be apparent, however, to those skilled in this art that many modifications and changes may be made without departing from the scope and spirit of the invention. It is further apparent that persons of ordinary skill in this art will, on the basis of this disclosure, be able to practice the invention within a broad range of process conditions. It is my intention in the following claims to cover all such equivalent modifications and variations as fall within the true scope and spirit of my invention.

What is claimed is:

1. A method for restoring to environmentally acceptable levels the soluble molybdenum values in a subterranean formation that has been subjected to oxidative in situ leaching which comprises passing through said formation an aqueous restoration fluid containing from about 25 to about 400 mg per liter ferrous ion whereby the formation of undesirable insoluble ferrous oxide, ferrous hydroxide, or both is suppressed.

2. The method of claim 1, wherein the ferrous ion is introduced into the formation as aqueous $FeCl_2$ or $FeSO_4$.

3. The method of claim 1 or 2, wherein the restoration fluid is deoxygenated to an oxygen concentration of 1 ppm or less prior to passing said fluid through the formation.

4. The method of claim 3, which further comprises a subsequent step of lowering the ferrous ion concentration in the formation to environmental background levels by passing formation water through the formation.

* * * * *